United States Patent [19]

Desmet et al.

[11] Patent Number: 5,002,098

[45] Date of Patent: Mar. 26, 1991

[54] DEVICE FOR BRAKING A WEFT THREAD IN A WEAVING MACHINE

[75] Inventors: Bertrand Desmet, Roeselare; Henry Shaw, Vleteren, both of Belgium

[73] Assignee: Picanol N.V., Belgium

[21] Appl. No.: 480,206

[22] Filed: Feb. 14, 1990

[30] Foreign Application Priority Data

Feb. 16, 1989 [BE] Belgium ..... 8900156

[51] Int. Cl.[5] ..... D03D 47/34

[52] U.S. Cl. ..... 139/194; 139/450; 139/453; 188/65.1; 188/158; 112/255

[58] Field of Search ..... 200/61.18; 340/677; 242/129.8, 156, 149; 112/255, 229, 254; 139/453, 450, 194; 66/134, 146; 28/211; 188/65.1, 158

[56] References Cited

U.S. PATENT DOCUMENTS

| | | | |
|---|---|---|---|
| 3,129,902 | 4/1964 | Juillard | 139/450 X |
| 4,175,307 | 11/1979 | Altenneger | 139/194 X |
| 4,479,519 | 10/1984 | Deborde et al. | 139/450 |
| 4,598,184 | 7/1986 | Price et al. | 200/61.18 |
| 4,641,688 | 2/1987 | Gehring | 242/149 X |
| 4,817,681 | 4/1989 | Krumm et al. | 139/450 |
| 4,875,506 | 10/1989 | Gacsay et al. | 188/65.1 X |

FOREIGN PATENT DOCUMENTS

| | | | |
|---|---|---|---|
| 3113088A1 | 10/1982 | Fed. Rep. of Germany . | |
| 2568595 | 2/1986 | France . | |
| 63-275387 | 11/1988 | Japan | 112/254 |

*Primary Examiner*—Andrew M. Falik

*Attorney, Agent, or Firm*—Bacon & Thomas

[57] ABSTRACT

A thread brake for braking a weft thread in a weaving machine includes a rigid stop and an elastically deformable blade which has a free end supported to press resiliently against the rigid stop. Thread guides are provided to guide weft threads between the rigid stop and the elastically deformable blade. The thread brake is activated when the deformable blade elastically presses against the rigid stop. When contacted by a switching device, however, the elastically deformable blade is pushed against its resilient force and removed from the rigid stop, at least in the region of the switching device, deactivating the thread brake.

19 Claims, 4 Drawing Sheets

21
20
22
29
F5
4
25
IV
32
28
33
1
37
27
24
34
18
16
35
14
15
12
13
IV
F3
17

41
17
40
39
42
18
13
16
34
35
24
12
14
33
15
30
28
A
B
29
1
32
25
27
26
31

Fig. 6
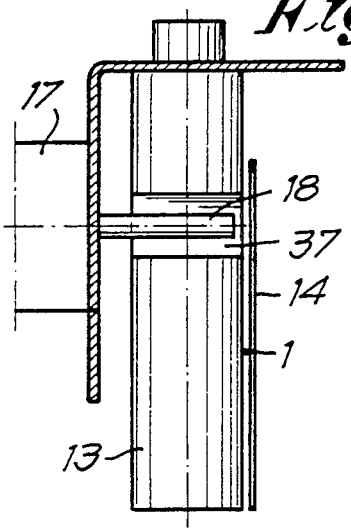
Fig. 7
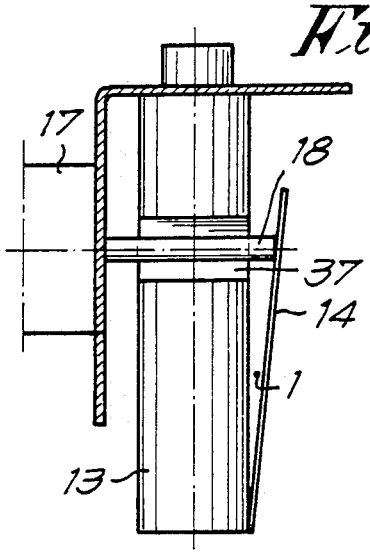
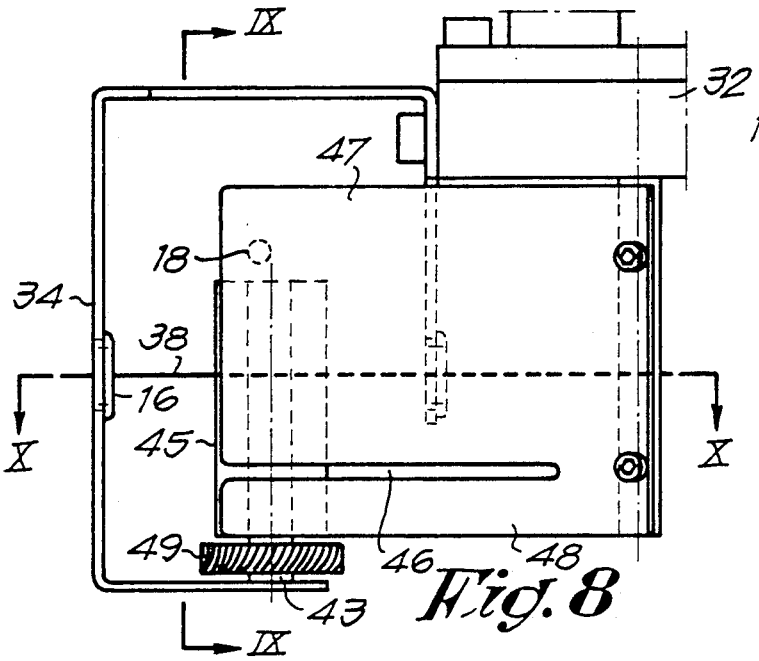
Fig. 8
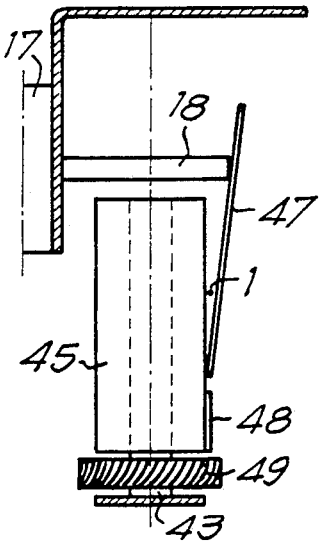
Fig. 9
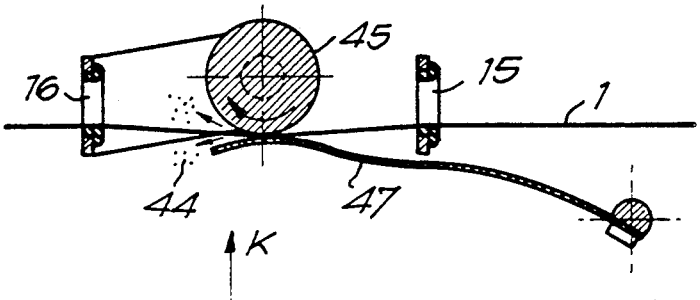
Fig. 10
Fig. 11
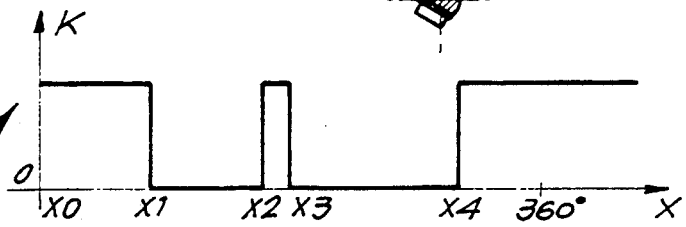

DEVICE FOR BRAKING A WEFT THREAD IN A WEAVING MACHINE

BACKGROUND OF THE INVENTION

This invention concerns a device for braking a weft thread in a weaving machine. The device can be used in all types of weaving machines, but is particularly intended for rapier weaving machines.

It is known that in modern, high-speed rapier weaving machines the weft threads must be inserted into the shed in a controlled manner, in other words, each weft thread must be braked or released at the right moments and during particular periods of time in the weft insertion cycle. During the insertion movement of the grippers, on the one hand the braking must be kept to a minimum, both when the weft threads are being accelerated and during their rapid travel, in order to limit the tension in the weft thread and so prevent weft breaks. On the other hand, when the rate of travel of the grippers and of the weft thread is decelerating, and during the standstill of the weft thread, the weft thread must be braked in order to keep it taut and prevent weaving faults, or in order to keep the thread in a desired position.

SUMMARY OF THE INVENTION

The present invention has as its object a device for braking a weft thread, whereby the braking on the weft thread can be released entirely at the right moments and during the right periods in time of the weft insertion cycle, such that the weft thread is not loaded more than necessary. A particular advantage of the device according to the invention is that the braking force can be supplied or removed instantly.

The present invention also has as its object a device which allows better control over the tensioning of the weft thread during the transfer between the feed gripper and the receiving gripper.

Further, the invention has as its object a device which makes it possible to adjust the moment of commencement of the braking of the weft thread at the end of the insertion in a very simple way, such that by braking the weft thread sooner or later the weft thread is released either more or less rapidly from the opened clip of the feed gripper, whereby the waste length of the weft thread can be reduced to a minimum by the control of the device.

For these purposes, a thread brake according to the invention includes a rigid stop and an elastically deformable blade with a free end which presses resiliently against the rigid stop, thread guides to guide a weft thread between the rigid stop and the blade which operates in conjunction with it, and a switching device which can be moved between two positions by means of an electromagnet and which can operate in conjunction with the elastically deformable blade. In the first position of the switching device, the elastically deformable blade presses against the rigid stop, such that the thread brake is activated, while in the second position, the elastically deformable blade is removed from the stop by means of the switching device, at least in the region of the switching device, such that the braking action on the weft thread is removed.

BRIEF DESCRIPTION OF THE DRAWINGS

In order to better describe the characteristics of the invention, various preferred embodiments are now described, by way of example only and without being limitative in any way, with reference to the accompanying drawings, where:

FIG. 6 shows the device according to the invention during the braking of a weft thread, in particular in a cross-section along line VI—VI in FIG. 5;

FIG. 7 shows the device according to the invention in a similar view as in FIG. 6, in the position in which the braking is removed;

FIG. 8 shows a variant of a device according to the invention, in a similar view as in FIG. 5;

FIGS. 9 and 10 show cross-sections along lines IX—IX and X—X respectively, in FIG. 8;

FIG. 11 is a graph showing the manner in which the electromagnetic drive of the device according to the invention is energized during a weaving cycle.

DETAILED DESCRIPTION OF THE PREFERRED EMBODIMENTS

Figure 1:
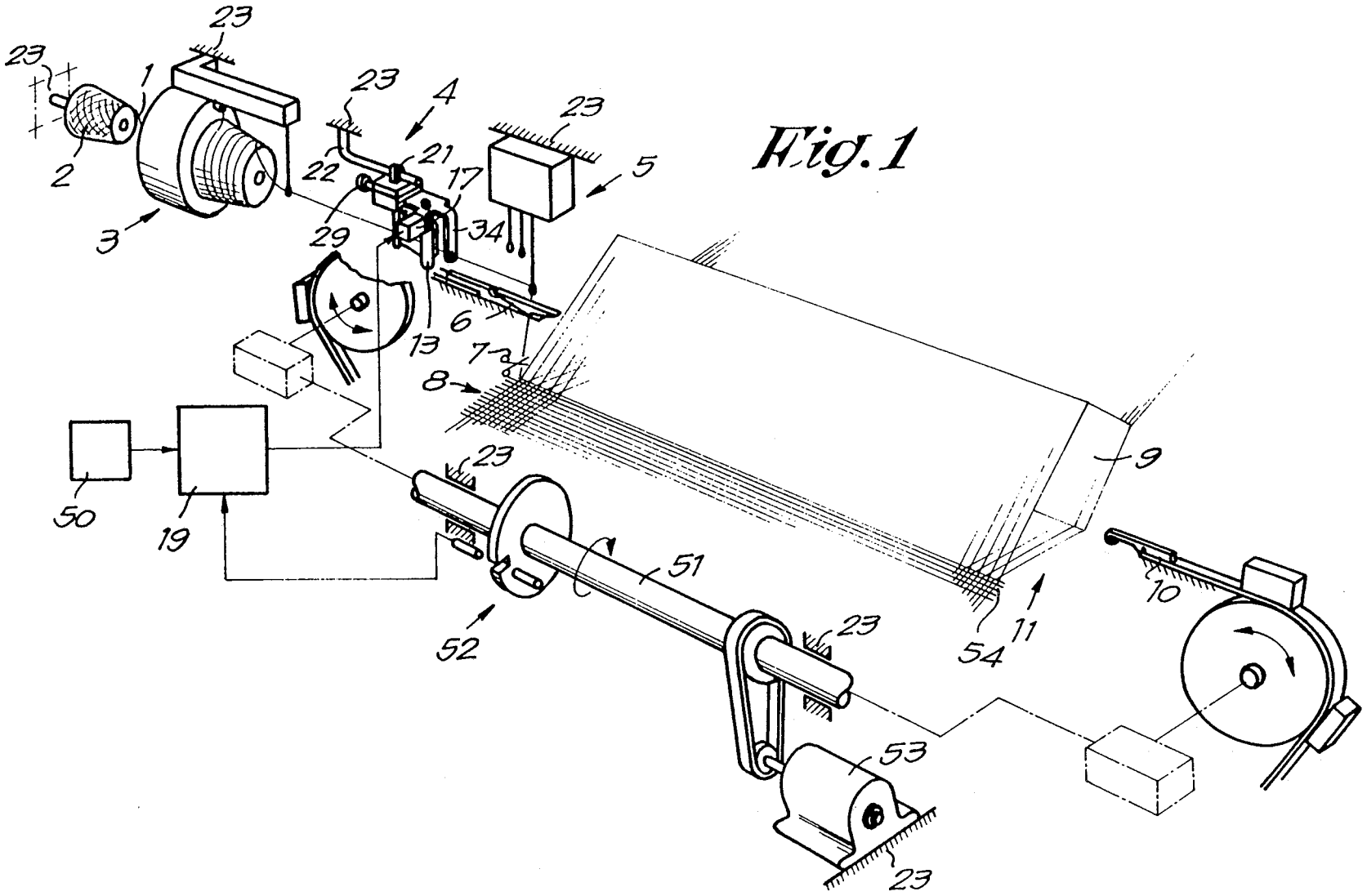
FIG. 1 is a schematic diagram of a device according to the invention in a rapier weaving machine.

It is known that, as shown in FIG. 1, each of the weft threads 1 on rapier weaving machines can be brought into the path of the feed gripper 6 from a yarn package 2, via a thread accumulator device 3 and via a device 4 for braking the weft thread 1, by means of a thread presentation device 5. For the sake of clarity, the figure shows the supply of only one weft thread 1. The presented weft thread 1 is gripped in the known manner by means of the feed gripper 6 and cut loose by means of a cutter 7 at the cloth edge. Next, the feed gripper 6 pulls the weft thread 1 into the shed 9, transfers it to the receiving gripper 10 halfway along the shed 9, which then takes it to the end 11 of the shed 9.

The present invention concerns the device 4 for braking the weft thread 1, such that the purposes set out in the introduction are met.

As shown in FIGS. 2 to 5, this device 4 includes a thread brake 12. Thread break 12 includes a rigid, i.e. inflexible, stop 13 and an elastically deformable blade 14 which co-operates with the rigid stop, and thread guides to guide the weft thread 1 between the rigid stop 13 and the elastically deformable blade 14 co-operating with it. In the embodiment shown in FIGS. 2–5, the thread guides include two thread eyes 15 and 16. Thread brake 12 also includes a switching device, preferably a pusher 18, which can be moved between two positions by means of an electromagnet 17 and which can co-operate with the elastically deformable blade 14, so that the latter can be removed from the rigid stop by the pusher at the desired moments and during certain periods in the weft insertion cycle. Electromagnet 17 is controlled by means of controlling means 19.

In the embodiment shown, the above-mentioned parts are mounted on a structure 20 by means of attachments 21. Structure 20 is suspended from a bar 22, which in turn is connected to the frame 23 of the weaving machine or a package frame.

The above-mentioned rigid stop 13 consists of a cylinder. The elastically deformable blade 14 is mounted so that its free end presses against the cylinder wall of the rigid stop 13. Both the rigid stop 13 and the elastically deformable blade 14 are preferably arranged vertically.

Figure 2:
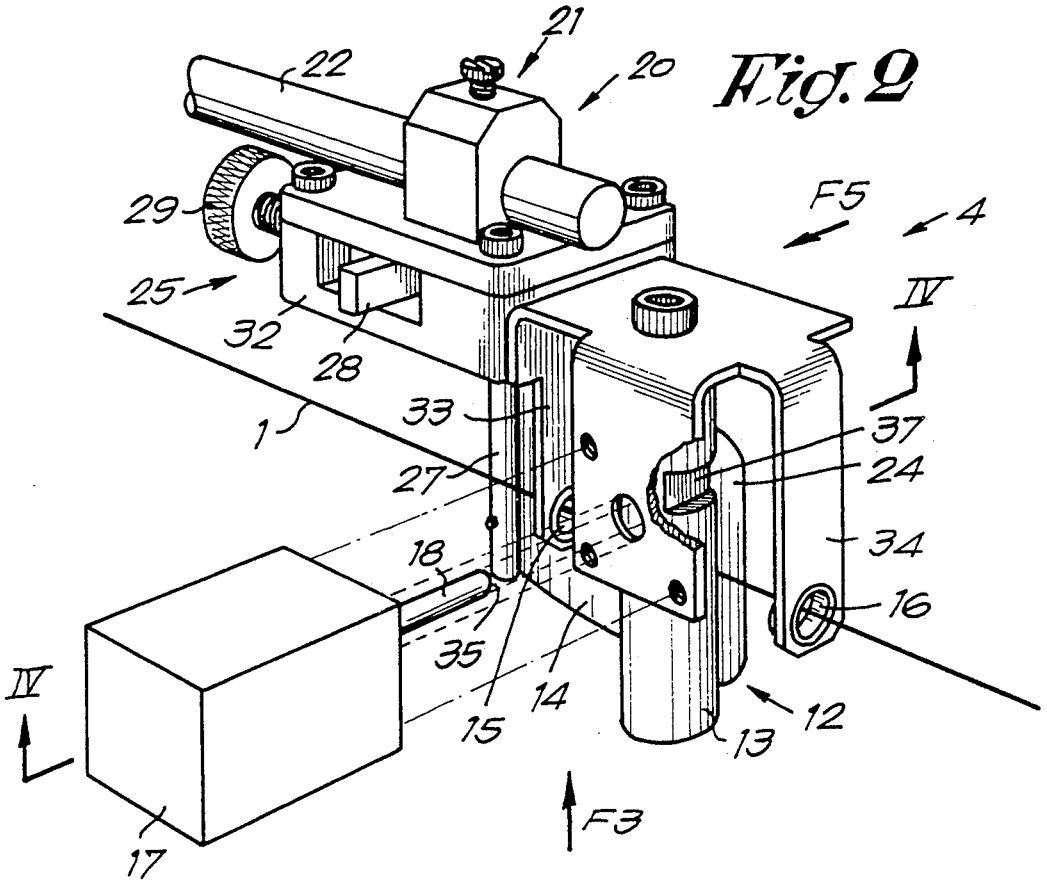
FIG. 2 is a detailed perspective view of the device according to the invention.
Figure 3:
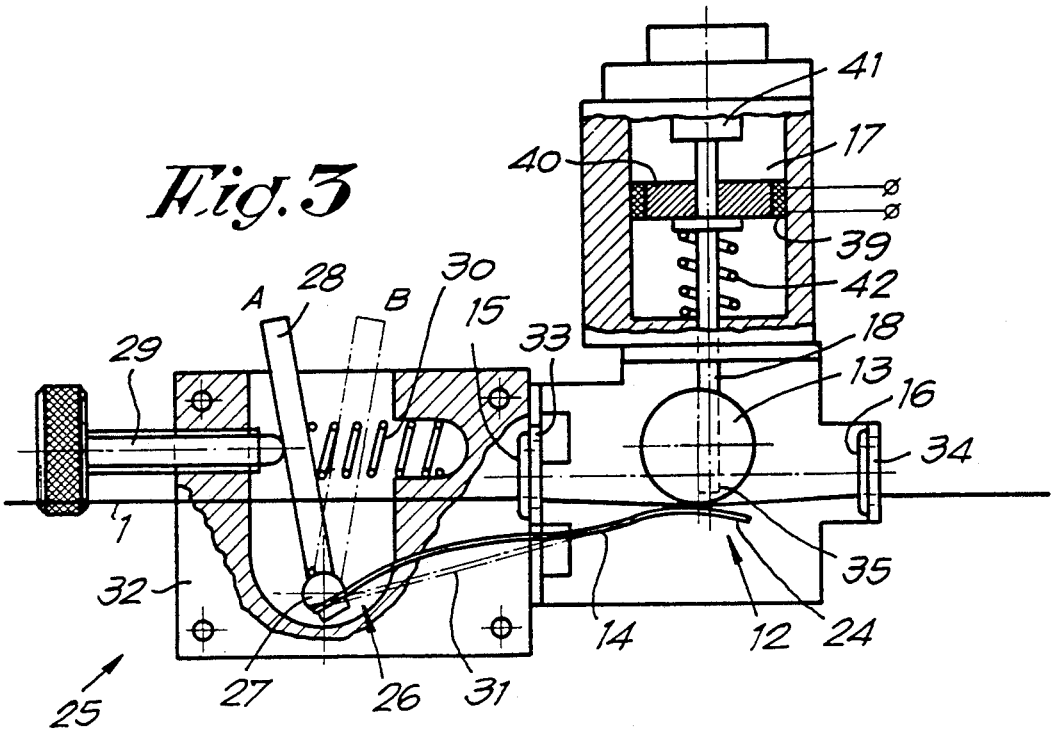
FIG. 3 is a bottom view in the direction, of arrow F3 in FIG. 2.

As shown in FIGS. 2 and 3, the device 4 preferably has adjusting means 25 to adjust the force with which the elastically deformable blade 14 presses against the rigid stop 13. For this purpose, the elastically deformable blade 14 is fixed at the end 26 opposite the free end 24 to a shaft 27 which can be rotated by means of a small lever 28 whose position can be adjusted by means of the set screw 29. Contact between the small lever 28 and the set screw 29 is ensured by an elastic means, such as a pressure spring 30. By screwing in set screw 29 or by rotating the small lever 28 from position A to position B, any desired braking force of the elastically deformable blade 14 on weft thread 1 can be set. In position B, the elastically deformable blade has a shape indicated by reference 31. The whole assembly can be mounted in a housing 32.

The thread eyes 15 and 16 are mounted in supports 33 and 34 connected to the basic structure 20, such that a weft thread 1 drawn between them passes between the rigid stop 13 and the elastically deformable blade 14, approximately in the middle of the elastically deformable blade 14.

Figure 4:
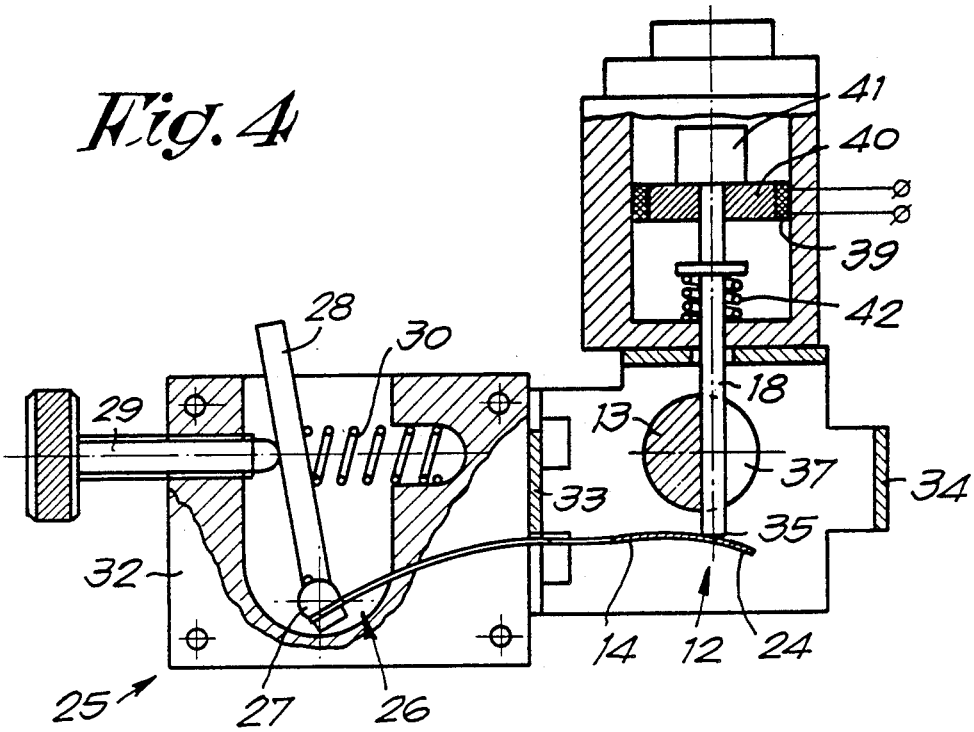
FIG. 4 is a cross-sectional view along line IV—IV in FIG. 2.
Figure 5:
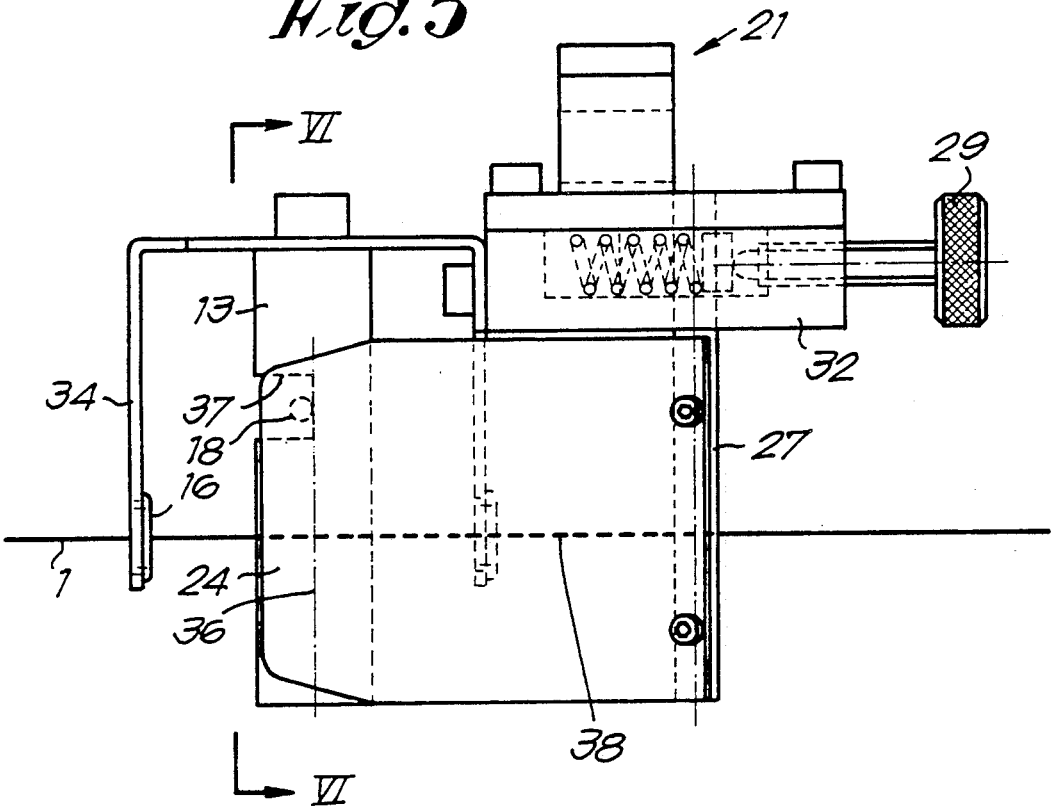
FIG. 5 is a side view in the direction of arrow F5 in FIG. 2.

In the embodiment shown, the above-mentioned pusher 18 includes a small bar which can make contact with the elastically deformable blade 14. This pusher 18 can take two positions. The first is a withdrawn position, where, as shown in FIG. 3, the end 35 is removed from the elastically deformable blade 14, such that the latter presses against the rigid stop 13 with full force. The second position is a protruding position where, as shown in FIG. 4, the pusher 18 pushes the elastically deformable blade away from the rigid stop at least in the region of said pusher. The contact-point of the pusher 18 on the elastically deformable blade 14 lies on or almost on the contact line 36 in which the elastically deformable blade normally presses against the rigid stop 13. This has the advantage that the braking force on the weft thread can be applied and removed instantaneously. As the contact-point of the pusher 18 lies on the contact line 36, the slightest bending of the blade 14 results in the braking force being removed. In order to ensure that the pusher 18 can act in the above-mentioned contact line 36, the cylinder-shaped rigid stop 13 has a local notch 37, which is clearly shown in FIGS. 2, 4 and 5.

The two positions of the switching device, or in this case the pusher 18, are shown in detail in FIGS. 6 and 7. The pusher 18 pushes on the elastically deformable blade 14, away from the longitudinal axis 38, with the effect that, as shown in FIG. 7, only one side of the elastically deformable blade 14 is pushed away from the rigid stop rigid stop 13, while the other side remains in contact with it. One of the advantages is that, although the weft thread is not braked any more, it is still locked in from all sides, such that the thread cannot possibly escape from the device 4.

It is clear that the construction of the electromagnet 17 can be of various kinds. In the example according to FIG. 3 electromagnet 17 includes a solenoid 39, wound round a core 40, such that supplying a voltage to the solenoid causes an armature 41 connected the pusher 18 to be pulled towards the core 40. When the electromagnet is de-energized, the pusher 18 is returned by means of return spring 42.

In the variant according to FIGS. 8 and 10, the above-mentioned rigid stop 13 consists of a cylinder which can rotate round a shaft 43, such that dust particles 44 are removed as a result of the rotating movement through the thread brake 12. It is clear that the thread guides and cylinder must be positioned such that the movement of the weft thread 1 causes the desired rotation. For this purpose, the thread eyes are arranged so that, as shown in FIG. 10, the weft thread 1 is bent through a small angle over the cylinder-shaped surface 45. In order to prevent the rigid yet rotatable stop 13 from rotating too far due to its inertia when the weft thread is braked, the elastically deformable blade 14 is divided into two parts 47 and 48 by means of a longitudinal notch 46. As shown in FIG. 9, part 47 is the brake blade for the weft thread 1 which, by means of the pusher 18 or another similar switching device, can be pushed away from the rotatable stop 13. The second part 48, in contrast, is a brake blade whose flat side, regardless of the position of the pusher 18, always remains in contact with the rotatable stop 13 and so brakes it constantly. In order to improve the dust removal, a small fan formed by a paddle wheel 49 can be mounted on the rotatable stop 13, such that an air stream is created in the direction of the longitudinal axis of the rotatable stop 13.

The operation of the device 4 can be simply deduced from the figures. As described above, the weft thread 1 is guided through the thread brake 12 and will then be braked or not depending on whether the electromagnet 17 is switched off or on. The braking force can be adjusted by means of the adjusting device 25, which is done mechanically and manually, after which the adjustment is not changed during the operation of the weaving machine. The control means 19 ensure that the electromagnet 17 is switched on during preset periods of time.

It is clear that the control means 19 can be of various types. In the first place, the intention is for the weft tension variations for a particular weft thread 1 to be repeated during each weaving cycle. For this purpose, the periods during which the electromagnet 17 must be energized, as a function of the weft insertion cycle or in other words the number of crank angle degrees of the weaving machine, must be input or programmed beforehand by means of an input unit 50. In order to make the braking cycles run simultaneously with the drive of the weaving machine, the controlling means 19 can for example be triggered by means of a pulse generator 52 mounted on the main shaft 51 of the weaving machine. The main drive of the weaving machine is indicated schematically by reference 53.

Control of the thread brake 12 is preferably as shown in FIG. 11, in which the braking force K is shown as a function of the rotation of the main axis, measured in crank angle degrees X. The weft thread 1 is braked between X0 and X1, between X2 and X3 and from X4 onwards. It is clear that for this purpose the electromagnet 17 is energized during the periods X1–X2 and X3–X4. During the period X0–X1 the weft thread 1 is picked up by the feed gripper, while during the period X2–X3 the weft thread 1 is handed over to the receiving gripper. It is clear that during these periods the brake must be activated in order to ensure that the thread is kept taut. At the end of the insertion, at X4, the thread is also braked. By choosing a different value for moment X4, the amount of thread waste 54 can be changed. By activating the brake earlier, it becomes possible for the weft thread to be released more quickly from the opened clip of the receiving gripper 10. X1 is preferably situated between 50 and 100 crank angle degrees, X2 between 160 and 180 crank angle degrees, X3 between 180 and 200 crank angle degrees and X4 between 270 and 310 crank angle degrees.

The present invention is not limited to the embodiments described by way of example and shown in the figures; on the contrary, such a device for braking a weft thread in a weaving machine can be made in all sorts of forms and dimensions while still remaining within the scope of the invention.

We claim:

1. A device for braking a weft thread in a weaving machine, comprising a thread brake including a rigid stop and an elastically deformable blade, said blade including a free end which presses resiliently against said rigid stop; thread guide means for guiding the weft thread between the rigid stop and the blade; switching means movable between two positions for operating said thread brake by (1) in a first position, contacting the elastically deformable blade to move the blade against its resilient force away from the rigid stop, at least in the region of said switching device, thereby deactivating the thread brake, and (2) in a second position, releasing the blade such that the blade contacts the rigid stop, thereby activating the thread brake; electromagnetic means including an electromagnet for moving said switching means between said two positions; and control means for controlling the electromagnet.

2. A device as claimed in 1, wherein the rigid stop comprises a cylinder.

3. A device as claimed in claim 1, wherein said cylinder and said elastically deformable blade each extends in a vertical direction.

4. A device as claimed in claim 1, wherein said switching means comprises a pusher which contacts said blade to move said blade away from said rigid stop.

5. A device as claimed in claim 4, wherein said electromagnetic means moves said pusher into one of said two positions when said electromagnet is energized and wherein said pusher is moved into said other of said two positions by means of a return spring when the electromagnet is de-energized.

6. A device as claimed in claim 5, wherein said one of said two positions is said first position.

7. A device as claimed in claim 4, wherein the pusher is supported to make contact with the blade on or near a contact line at which the blade is supported to make contact with the rigid stop.

8. A device as claimed in claim 7, wherein the pusher is supported to pass through a notch in the rigid stop.

9. A device as claimed in claim 1, wherein the switching means is supported to contact a spot on the blade which lies outside a longitudinal axis of the elastically deformable blade such that only one side of the blade is removed from the rigid stop while the other side remains in contact with the rigid stop.

10. A device as claimed in claim 1, further comprising adjusting means for adjusting a force of the blade on the rigid stop and thus also a braking force on the weft thread.

11. A device as claimed in claim 10, wherein said adjusting means comprises attachment means for attaching said blade to a rotatable shaft at an end opposite said free end; means including a small lever for permitting the shaft to take different angular positions; means including a set screw for moving the lever; and elastic means for ensuring contact between the lever and the set screw.

12. A device as claimed in claim 1, wherein said thread guide means comprises two thread eyes.

13. A device as claimed in claim 12, wherein said thread eyes are mounted in relation to the rigid stop such that the weft thread is led through a small angle round the rigid stop.

14. A device as claimed in claim 1, wherein the rigid stop comprises a rotatable cylinder.

15. A device as claimed in claim 14, wherein said blade comprises two parts separated by a notch, one part combined with the rigid stop to form the thread brake, the other part constantly braking the rotatable cylinder.

16. A device as claimed in claim 14, wherein the rigid stop includes a fan in the shape of a paddle wheel.

17. A device as claimed in claim 1, wherein the weaving machine includes a feed gripper and a receiving gripper, and wherein the control means controls the switching means while the weft thread is being picked up by the feed gripper during transfer of the weft thread from the feed gripper to the receiving gripper, and at the end of a weft insertion cycle.

18. A device as claimed in claim 1, further comprising means for programming the control means via an input unit.

19. A device as claimed in claim 17, further comprising pulse generator means mounted on a main shaft of the weaving machine for triggering the control means.

* * * * *